US008246205B2

(12) United States Patent
Lai

(10) Patent No.: US 8,246,205 B2
(45) Date of Patent: Aug. 21, 2012

(54) LED LIGHT EMITTING DEVICE

(75) Inventor: Chih-Ming Lai, Miao-Li Hsien (TW)

(73) Assignee: Foxsemicon Integrated Technology, Inc., Chu-Nan, Miao-Li Hsien (TW)

( * ) Notice: Subject to any disclaimer, the term of this patent is extended or adjusted under 35 U.S.C. 154(b) by 156 days.

(21) Appl. No.: 12/889,433

(22) Filed: Sep. 24, 2010

(65) Prior Publication Data

US 2012/0019145 A1 Jan. 26, 2012

(30) Foreign Application Priority Data

Jul. 26, 2010 (TW) ..... 99124463 A

(51) Int. Cl.
*F21S 4/00* (2006.01)
*F21V 21/00* (2006.01)

(52) U.S. Cl. ..... 362/249.02; 362/276; 362/294; 362/311.02; 362/800; 362/802

(58) Field of Classification Search ..... 362/249.02, 362/276, 294, 311.02, 545, 800, 802
See application file for complete search history.

(56) References Cited

U.S. PATENT DOCUMENTS 7,211,771 B1 * 5/2007 Smith et al. ..... 219/502

* cited by examiner

*Primary Examiner* — Jason Moon Han
(74) *Attorney, Agent, or Firm* — Altis Law Group, Inc.

(57) ABSTRACT

An LED light emitting device includes an LED light emitting component comprising a visible LED die emitting visible light and an infrared LED die emitting infrared light, a power source driver for providing electric energy for the LED light emitting component, and a temperature sensor for sensing a surface temperature of an outer surface of the LED light emitting component. When a value of the surface temperature is smaller than zero degree Celsius, the temperature sensor outputs a control signal to the power source driver to control the power source driver to supply an electric current to the infrared LED die, whereby the infrared LED die radiates infrared light to melt ice on the outer surface of the LED light emitting component.

11 Claims, 8 Drawing Sheets

LED LIGHT EMITTING DEVICE

BACKGROUND

1. Technical Field

The present disclosure relates to an LED (light-emitting diode) light emitting device with good ice-proof performance.

2. Description of Related Art

An LED (Light-Emitting Diode) lamp as a new type of light source can generate brighter light, and have many advantages, e.g., energy saving, environment friendly and longer life-span, compared to conventional light sources. Therefore, the LED lamp has a trend of substituting for conventional light sources.

Many cities apply the LED lamps to street lamps and traffic lights for saving electric energy. However, the LED lamp generates less heat when working, thus the temperature of the light source of the LED lamp is lower than conventional light sources. After encountered a heavy snow weather, water vapor is often accumulated around the LEDs and then turns into ice, so that the road surface can not obtain enough illumination from the street lamps, and signals generated from the traffic light can not be seen clearly, which results in malfunctions of the street lamps and the traffic lamps or even traffic accidents.

What is needed, therefore, is an LED light emitting device which can overcome the limitations described.

DETAILED DESCRIPTION

Figure 1:
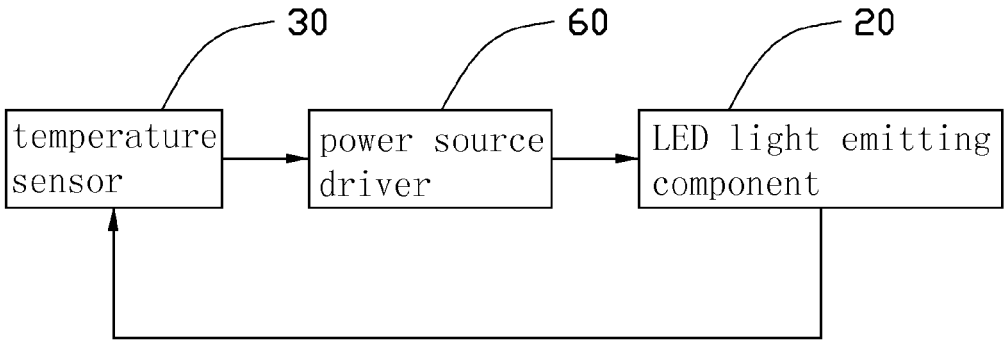
FIG. 1 is a block diagram of an LED light emitting device in accordance with a first embodiment of the disclosure.
Figure 2:
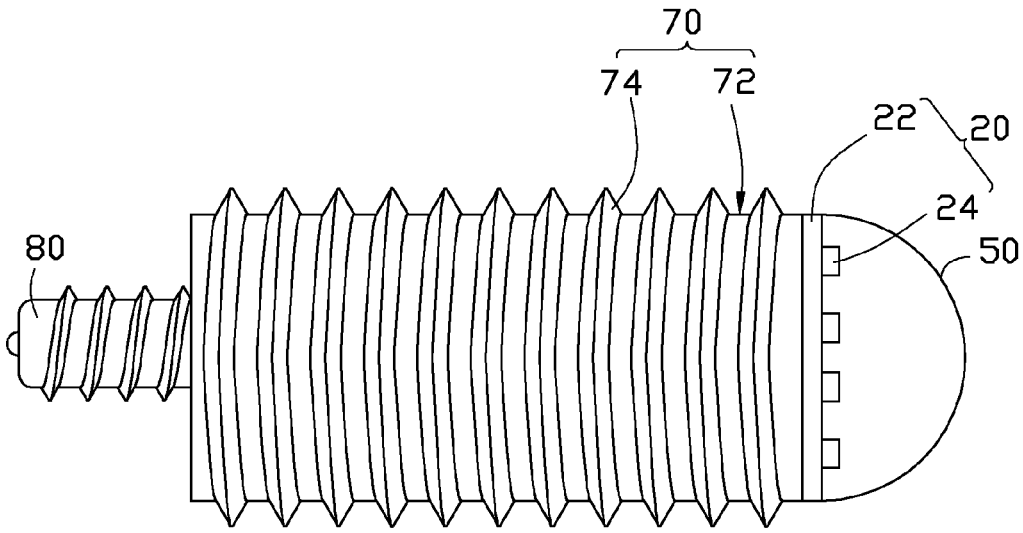
FIG. 2 is an isometric, assembled view of the LED light emitting device of FIG. 1.

Referring to FIGS. 1-2, an LED light emitting device in accordance with a first embodiment is shown. The LED light emitting device includes an LED light emitting component 20, a heat sink 70 thermally connecting the LED light emitting component 20, a connecting head 80 electrically connecting the LED light emitting component 20, a temperature sensor 30 connected to the LED light emitting component 20, and a power source driver 60 for providing electric energy for the LED light emitting component 20.

The heat sink 70 is integrally made of a metal with good heat conductivity such as aluminum, copper or an alloy thereof. The heat sink 70 comprises a base and a plurality of fins 74 formed on an outer surface of the base. The base of the heat sink 70 is columnar, and defines a circular face 72 at an outer circumference of the heat sink 70. The LED light emitting component 20 is thermally attached on one end of the base, and the connecting head 80 extends from another end of the base opposite to the LED light emitting component 20. The fins 74 are arranged on the circular face 72 of the base and spaced from each other. The fins 74 extend spirally along an axis of the base, acting as threads around the base. An envelope 50 covers the LED light emitting component 20, for isolating water vapor from the LED light emitting component 20.

Figure 3:
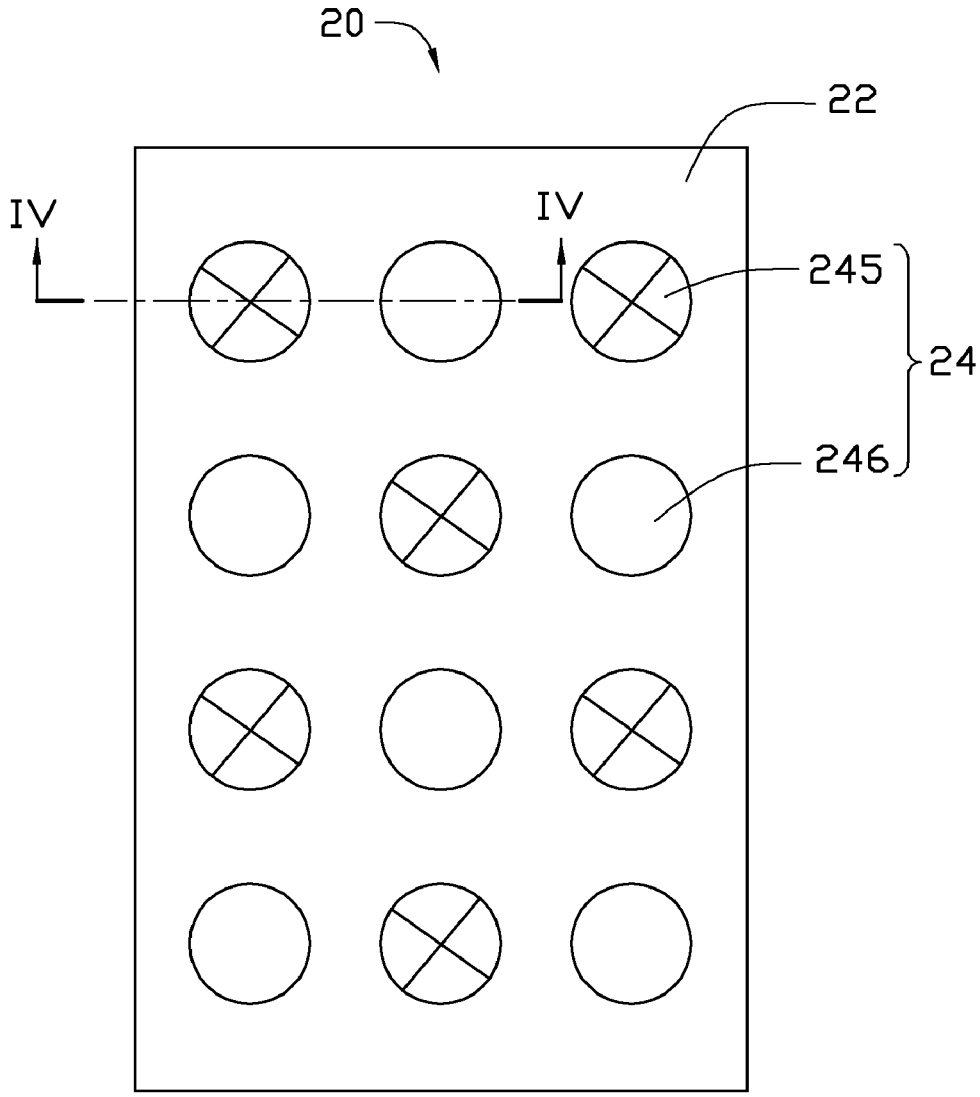
FIG. 3 is a schematic view of an LED light emitting component of the LED light emitting device of FIG. 1.
Figure 4:
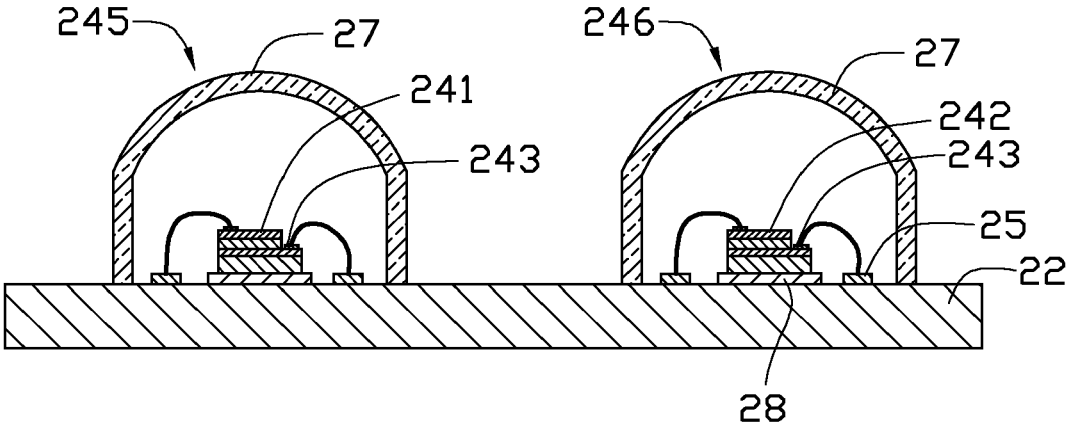
FIG. 4 is a cross-section view of the LED light emitting component of FIG. 3, taken along a line IV-IV thereof.

Also referring to FIGS. 3-4, the LED light emitting component 20 includes a flat heat conductive plate 22, a plurality of LEDs 24 thermally attached to the heat conductive plate 22, and an electrode circuit layer 25 formed on the heat conductive plate 22. The LEDs 24 include a plurality of visible LEDs 245 emitting visible lights with wavelengths ranged from 400 nm to 800 nm, and a plurality of infrared LEDs 246 emitting infrared light with wavelengths larger than 800 nm. The wavelength range of infrared light emitted from the infrared LEDs 246 is preferably selected from 900-1000 nm, 1100-1200 nm, 1400-1500 nm, 1850-2100 nm or 2400-2600 nm, and infrared light with these wavelength ranges can be absorbed easily by ice and has a favorable property to melt ice. The visible LEDs 245 and the infrared LEDs 246 are alternately arranged on the heat conductive plate 22.

Particularly referring to FIG. 4, each visible LED 245 includes a visible LED die 241, two electrodes 243 formed on the visible LED die 241, and an encapsulant 27 encapsulating the visible LED die 241 for isolating water vapor from the visible LED die 241. The difference of the visible LED 245 relative to the infrared LED 246 is just that: the infrared LED 246 includes an infrared LED die 242. The electrodes 243 electrically connect with the electrode circuit layer 25.

The visible LED die 241 employs a semiconductor material capable of emitting visible light. The infrared LED die 242 employs a semiconductor material capable of emitting infrared light; for example, the infrared LED die 242 can be of nitride, arsenide, phosphide, telluride or antimonide.

The heat conductive plate 22 employs a ceramic material with properties of electrically insulating, high thermal conductivity and low thermal expansion, such as $Al_xO_y$, AlN or $ZrO_2$, so that the electrode circuit layer 25 can be directly formed on the heat conductive plate 22. The heat conductive plate 22 and the LEDs 24 are joined together by eutectic bonding, whereby a eutectic layer 28 is formed between the heat conductive plate 22 and the LEDs 24. The eutectic layer 28 contains at least one metal selected from Au, Sn, In, Al, Ag, Bi, Be or an alloy thereof. The electrode circuit layer 25 is spaced from the eutectic layer 28.

The encapsulant 27 can be made of silicone, epoxy resin or PMMA (polymethyl methacrylate). To convert wavelength of light generated from the LEDs 24, a fluorescent material such as sulfides, aluminates, oxides, silicates or nitrides, can be filled and scattered in the encapsulant 27.

Figure 5:
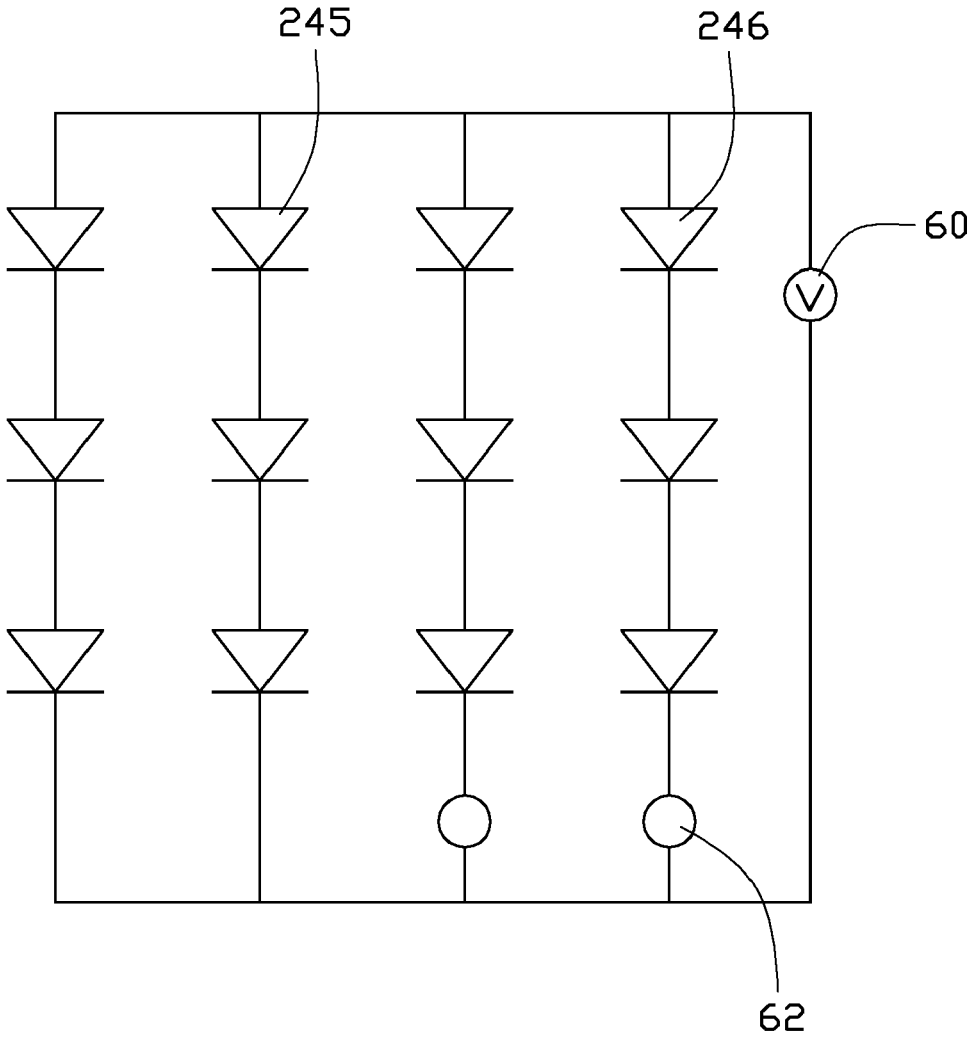
FIG. 5 is a circuitry of the LED light emitting device of FIG. 2.

Also referring to FIG. 5, a circuitry of the LED light emitting device is shown. In this circuitry, the LED light emitting component 20 includes two first branches and two second branches connected in parallel. The power source driver 60 connects each of the first and second branches for providing electric energy for the first and second branches. Each first branch includes three visible LEDs 245 connected in series, and each second branch includes three infrared LEDs 246 connected in series. A switch 62 is connected to an end of each second branch. The switch 62 can be a metallic oxide semiconductor field effect transistor (MOSFET).

The temperature sensor 30 is attached to an outer surface of the LED light emitting component 20 for sensing a surface temperature of the outer surface of the LED light emitting component 20. When the LED light emitting device works, the power source driver 60 provides electric energy for the visible LED dies 241 to make the visible LED dies 241 radiate visible lights for illumination. When a value of the surface temperature is smaller than zero Celsius degree, the temperature sensor 30 outputs a control signal to the power source driver 60 to control the power source driver 60 to supply an electric current to the infrared LED dies 242. Thus, the infrared LED dies 242 radiate infrared lights to melt ice on the outer surface of the LED light emitting component 20, thereby maintaining the surface temperature of the LED light emitting component 20 to be larger than zero Celsius degree, and preventing the LEDs 24 of the LED light emitting component 20 from being covered by ice.

Figure 6:
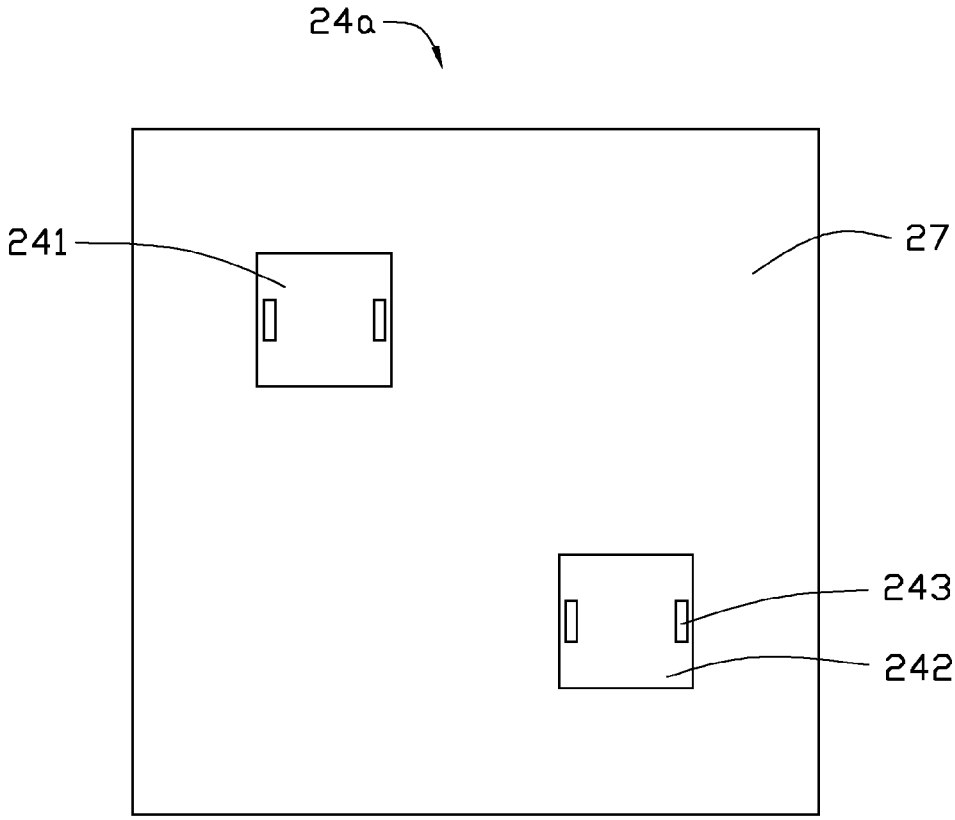
FIG. 6 is a schematic view of an LED of an LED light emitting device in accordance with a second embodiment of the disclosure.

Also referring to FIG. 6, an LED 24*a* of an LED light emitting device in accordance with a second embodiment is shown. The differences of the second embodiment relative to the first embodiment are that: the LED 24*a* includes a visible LED die 241 and an infrared LED die 242 both thermally attached to the heat conductive plate 22, four electrodes 243 for the visible LED die 241 and the infrared LED die 242, and an encapsulant 27 encapsulating the visible LED die 241 and the infrared LED die 242.

Figure 7:
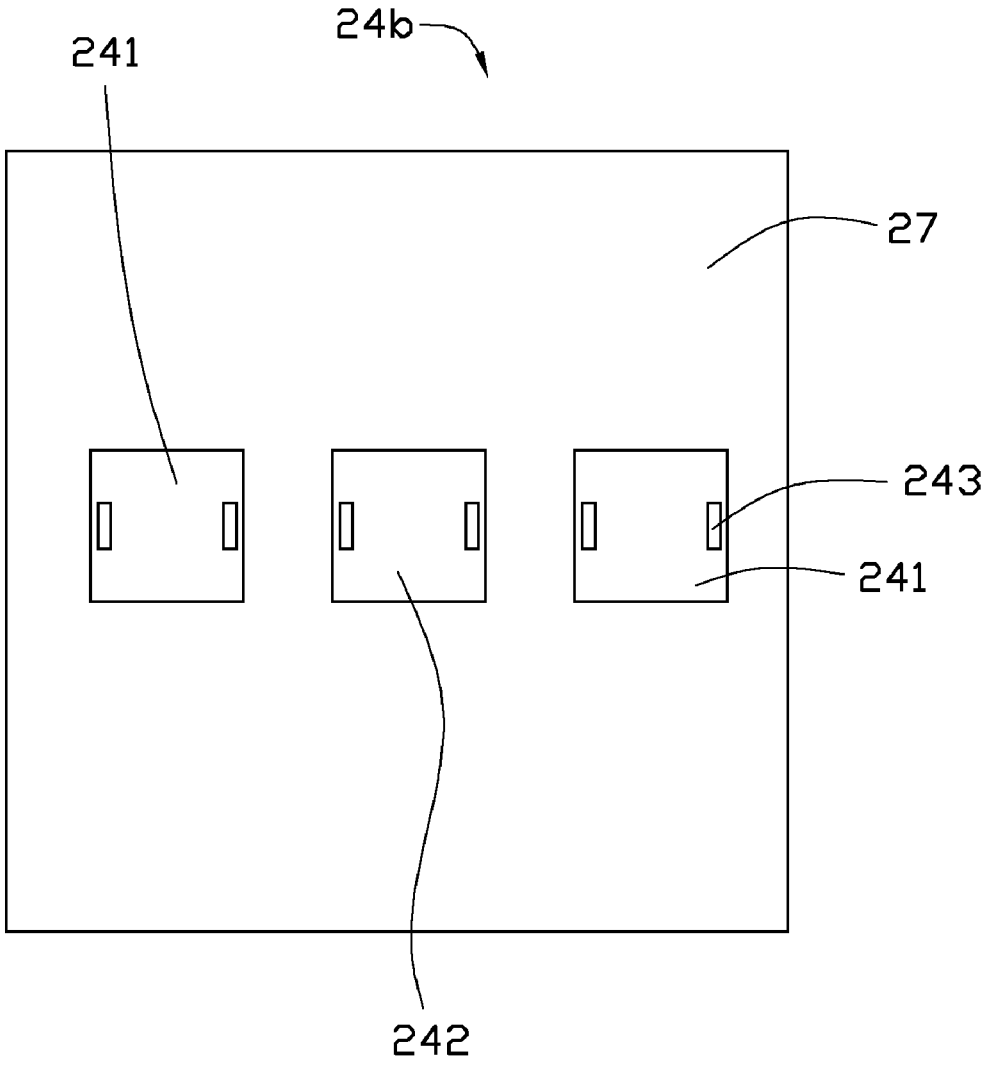
FIG. 7 is a schematic view of an LED of an LED light emitting device in accordance with a third embodiment of the disclosure.

Also referring to FIG. 7, an LED 24*b* of an LED light emitting device in accordance with a third embodiment is shown. The differences of the third embodiment relative to the second embodiment are that: the LED 24*b* includes an infrared LED die 242, two visible LED dies 241 located at two sides of the infrared LED die 242, six electrodes 243 for the two visible LED dies 241 and the infrared LED die 242, and an encapsulant 27 encapsulating the two visible LED dies 241 and the infrared LED die 242, wherein the two visible LED dies 241 and the infrared LED die 242 are thermally attached to the heat conductive plate 22, and the two visible LED dies 241 are capable of respectively radiating visible lights with two different color temperatures.

Figure 8:
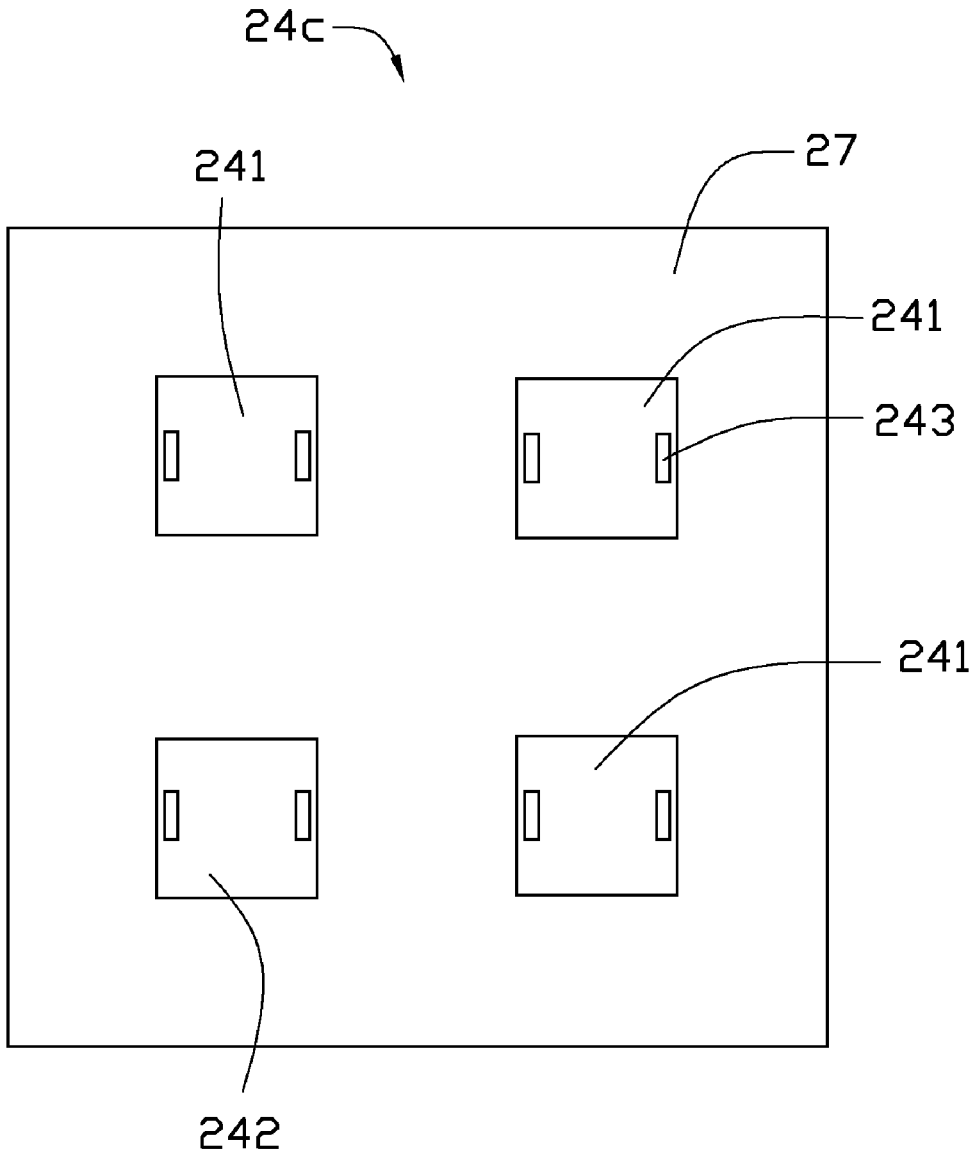
FIG. 8 is a schematic view of an LED of an LED light emitting device in accordance with a fourth embodiment of the disclosure.

Also referring to FIG. 8, an LED 24*c* of an LED light emitting device in accordance with a fourth embodiment is shown. The differences of the fourth embodiment relative to the third embodiment are that: the LED 24*c* includes an infrared LED die 242, three visible LED dies 241, eight electrodes 243 for the three visible LED dies 241 and the infrared LED die 242, and an encapsulant 27 encapsulating the three visible LED dies 241 and the infrared LED die 242, wherein the three visible LED dies 241 and the infrared LED die 242 are thermally attached to the heat conductive plate 22, and the three visible LED dies 241 are capable of respectively radiating red, green and blue visible lights.

It is to be understood, however, that even though numerous characteristics and advantages of certain embodiments have been set forth in the foregoing description, together with details of the structures and functions of the embodiments, the disclosure is illustrative only, and changes may be made in detail, especially in matters of shape, size, and arrangement of parts within the principles of the disclosure to the full extent indicated by the broad general meaning of the terms in which the appended claims are expressed.

What is claimed is:

1. An LED light emitting device comprising:

an LED light emitting component comprising a visible LED die emitting visible light and an infrared LED die emitting infrared light;

a power source driver for providing electric energy for the LED light emitting component; and a temperature sensor for sensing a surface temperature of an outer surface of the LED light emitting component;

wherein when a value of the surface temperature is smaller than zero degree Celsius, the temperature sensor outputs a control signal to the power source driver to control the power source driver to supply an electric current to the infrared LED die, whereby the infrared LED die radiates infrared light to melt ice on the outer surface of the LED light emitting component.

2. The LED light emitting device of claim 1, wherein the LED light emitting component comprises a heat conductive plate and a plurality of LEDs thermally attached to the heat conductive plate.

3. The LED light emitting device of claim 2, wherein the plurality of LEDs comprise a plurality of visible LEDs and a plurality of infrared LEDs, and each of the visible LEDs comprises the visible LED die thermally attached to the heat conductive plate, two electrodes formed on the visible LED die, and an encapsulant encapsulating the visible LED die, and each of the infrared LEDs comprises the infrared LED die thermally attached to the heat conductive plate, two electrodes formed on the infrared LED die, and an encapsulant encapsulating the infrared LED die.

4. The LED light emitting device of claim 3, wherein the heat conductive plate and the LEDs are joined together by eutectic bonding, whereby a eutectic layer is formed between the heat conductive plate and the LEDs.

5. The LED light emitting device of claim 4, wherein the LED light emitting component further comprises an electrode circuit layer formed on the heat conductive plate, the electrodes electrically connecting with the electrode circuit layer, the electrode circuit layer being spaced from the eutectic layer.

6. The LED light emitting device of claim 3, wherein the visible LEDs and the infrared LEDs are alternately arranged on the heat conductive plate.

7. The LED light emitting device of claim 3, wherein the LED light emitting component comprises a first branch and a second branch connected in parallel, the first branch comprises the visible LEDs connected in series, the second branch comprises the infrared LEDs connected in series, the power source driver connects each of the first and second branches, and a switch is connected between the power source driver and the second branch.

8. The LED light emitting device of claim 2, wherein each of the LEDs comprises a visible LED die and an infrared LED die both thermally attached to the heat conductive plate, four electrodes for the visible LED die and the infrared LED die, and an encapsulant encapsulating the visible LED die and the infrared LED die.

9. The LED light emitting device of claim 2, wherein each of the LEDs comprises two visible LED dies and an infrared LED die, six electrodes for the two visible LED dies and the infrared LED die, and an encapsulant encapsulating the two visible LED dies and the infrared LED die, the visible LED dies and the infrared LED die being thermally attached to the heat conductive plate, the two visible LED dies being capable of radiating visible lights with two different color temperatures.

10. The LED light emitting device of claim 2, wherein each of the LEDs comprises three visible LED dies and an infrared LED die, eight electrodes for the three visible LED dies and the infrared LED die, and an encapsulant encapsulating the three visible LED dies and the infrared LED die, the three visible LED dies and the infrared LED die being thermally attached to the heat conductive plate, the three visible LED dies being capable of radiating red, green and blue visible lights, respectively.

11. The LED light emitting device of claim 2, further comprising a heat sink thermally connecting the LED light emitting component and a connecting head electrically connecting the LED light emitting component, the heat sink comprising a columnar base and a plurality of fins formed on an outer surface of the base, the LED light emitting component being thermally attached on one end of the base, the connecting head extending from another end of the base opposite to the LED light emitting component, the fins extending spirally along an axis of the base, acting as threads around the base.

* * * * *